United States Patent [19]

Barnett et al.

[11] 4,134,519

[45] Jan. 16, 1979

[54] DISPENSER FOR ELONGATE THIN FLEXIBLE ARTICLES

[76] Inventors: Burton Barnett, 12592 Martha Ann Dr., Rossmoor, Calif. 90720; David Brody, 406 Drury La., Beverly Hills, Calif. 90058

[21] Appl. No.: 844,289

[22] Filed: Oct. 21, 1977

[51] Int. Cl.[2] ..... B65H 1/06

[52] U.S. Cl. ..... 221/46; 221/62; 221/155; 221/312 R; 312/42

[58] Field of Search ..... 221/33, 45, 46, 61–63, 221/155, 197, 198, 281, 287, 303–306, 309, 311, 312 R; 312/42, 71

[56] References Cited

U.S. PATENT DOCUMENTS

| | | | |
|---|---|---|---|
| 636,413 | 11/1899 | Miller | 221/197 X |
| 2,141,684 | 12/1938 | Diemer | 221/251 X |
| 2,325,604 | 8/1943 | Gibbs et al. | 221/92 |
| 2,421,782 | 6/1947 | Gibbs et al. | 221/92 |
| 2,911,127 | 11/1959 | Driss et al. | 221/258 |
| 3,163,327 | 12/1964 | Maxwell | 221/197 X |
| 3,164,298 | 1/1965 | Repko | 221/282 |
| 4,048,864 | 4/1978 | Kibler | 312/42 |

*Primary Examiner*—Stanley H. Tollberg

*Assistant Examiner*—Francis J. Bartuska

*Attorney, Agent, or Firm*—Dos T. Hatfield

[57] ABSTRACT

A dispenser for elongate thin flexible articles that are stacked within a cartridge package is comprised of a cartridge holder to be vertically positioned and having a front access door and interior projections whereby a cartridge may be placed in the holder with the door open and maintained in a predetermined vertical position within the holder after the door is closed. The cartridge is provided with an opening at its lower end and the holder is provided with an opening at its lower end shaped to prevent the removal of an article unless it is gripped and flexed to conform to the opening. For this purpose, the lowermost article within the holder is held in an inclined position with one end on a step projection at the bottom of the holder and an intermediate portion of the lowermost article engaging a holder projection into the lower holder opening which is disengaged when the lowermost article is gripped and flexed in a manner to conform to the shape of the holder opening to permit removal of the lowermost article only. Window openings in both the door and cartridge allow the remaining supply of articles at the lower end of the cartridge within the holder to be viewed.

4 Claims, 11 Drawing Figures

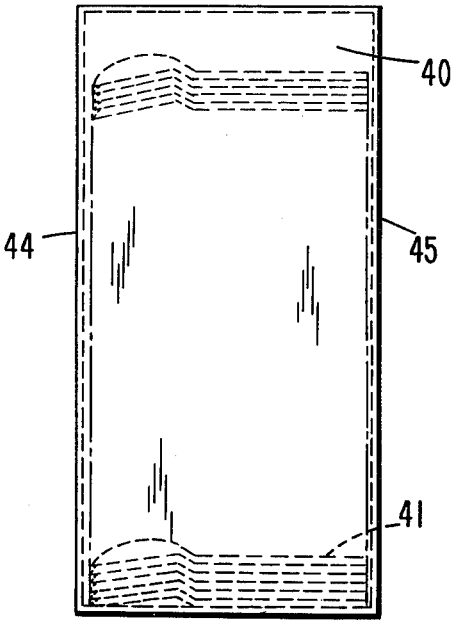
FIG. 3
FIG. 4
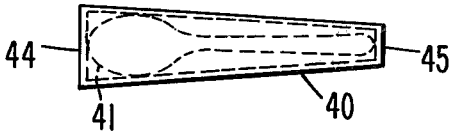
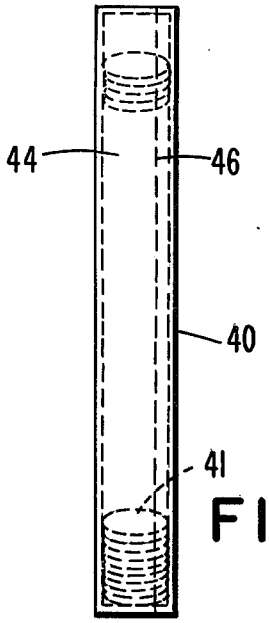
FIG. 5
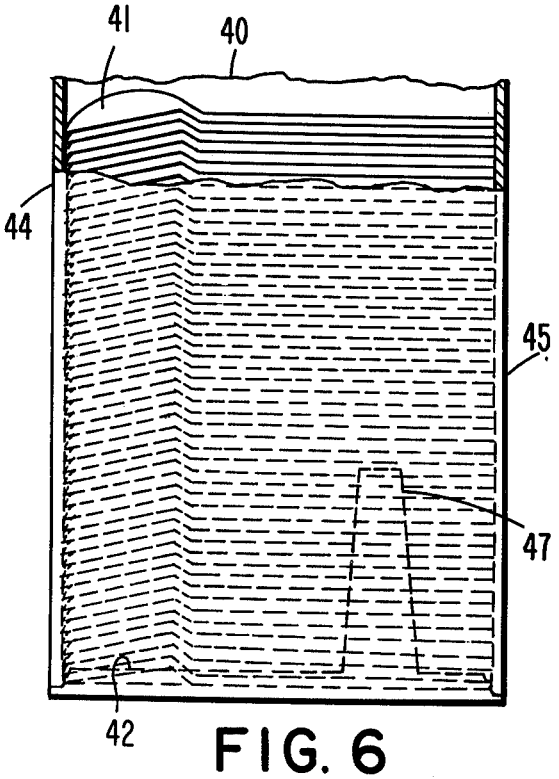
FIG. 6
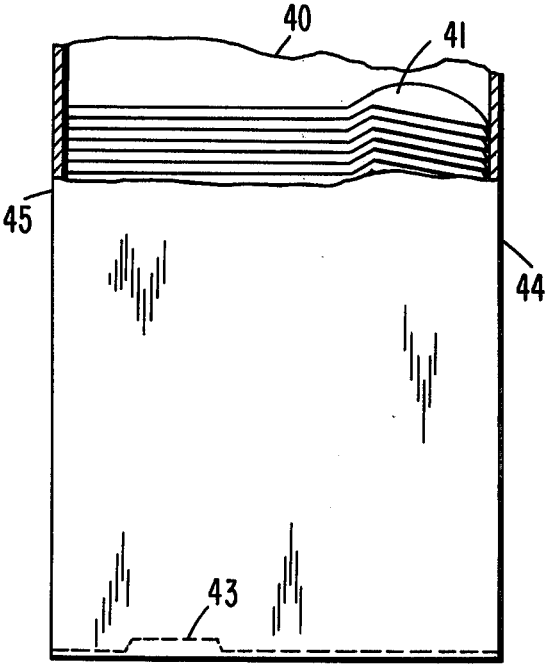
FIG. 7

DISPENSER FOR ELONGATE THIN FLEXIBLE ARTICLES

BACKGROUND OF THE INVENTION

Plastic spoons, forks, knives and the like are now being widely used in fast food establishments. It is therefore desirable to provide a cartridge holder dispenser which will enable large quantities of these articles to be stacked within a cartridge container to be shipped and sold for individual placement within the cartridge holder at the establishment so that individual articles of the plurality of articles stacked within the cartridge may be quickly and easily dispensed from the holder.

PRIOR ART

Spoon dispensing machines are shown in U.S. Pat. Nos. 2,325,604; 2,421,782 and 2,911,127. In addition, U.S. Pat. No. 3,164,298 shows a dispenser having an arrangement requiring that an article to be removed must be flexed to conform to the dispenser opening. However, none of the prior patents that are known to applicant disclose the particular combinational arrangement of this invention for a cartridge holder and cartridge for dispensing elongate thin flexible articles, such as plastic spoons, forks and knives, or the like.

SUMMARY OF THE INVENTION

The dispenser of the invention consists of a cartridge holder and a replaceable cartridge formed of sheet material, such as cardboard, and containing a plurality of stacked thin flexible and elongate articles such as plastic spoons, or the like. The holder is arranged to be vertically mounted at some convenient location within a food establishment and is provided with a front door to be opened for removing a spent cartridge and placing a new full cartridge within the holder. Suitably formed projections on the inside back wall of the holder serve to properly position the cartridge and hold it in place within the holder when the front door is closed. Both the cartridge and the holder are provided with openings at their lower ends to permit access to an article within the cartridge, but the opening of the holder has a projection normally engaging the lowermost article in a manner to prevent the article from being unintentionally removed from the cartridge and holder. For this purpose the holder is also provided with a lower upwardly extending step projection that engages one end of the lowermost article in the cartridge to thereby incline the article in a manner to cause engagement of the holder opening projection with the lowermost article intermediate the length of the article. The bottom opening of the holder is also shaped to enable a user to insert his fingers for grasping and flexing the lowermost article to enable disengagement of that article and the holder opening projection so that only the lowermost article, such as a plastic spoon, may be removed with the remainder of the stacked articles retained within the cartridge and cartridge holder. In order that the remaining supply of articles to be dispensed from within the cartridge within the holder may be viewed while the door of the cartridge holder remains closed, registering slotted openings in the door and the front wall of the cartridge at their lower ends are provided.

Since the articles to be dispensed normally are wider at one end than the other, i.e. the spoon end versus the handle end, the cartridge container, formed of cardboard or the like, is wider in cross-sectional dimension at one end than at the other end and the projections on the inside back wall of the cartridge holder are suitably formed to accommodate such cross-sectional dimensions of the cartridge. In addition, the wide end wall of the cartridge is provided with a fold line along its length intermediate its width to provide a degree of flexibility which serves to resiliently retain the cartridge within the holder when the door is closed in a manner to squeeze the cartridge in position.

Other features and advantages of the invention will be apparent with reference to the drawings and the detailed description in connection with the drawings.

BRIEF DESCRIPTION OF THE DRAWINGS

FIG. 3 is a view of the cartridge containing vertically stacked articles to be dispensed;

FIG. 4 is a top view of FIG. 3 showing the wider cross-sectional dimension at one end;

FIG. 5 is an end view of the wide side end of the cartridge and showing the fold line to permit flexing of that end of the cardboard cartridge when held in the holder with the holder door closed;

FIG. 6 is a front view of the lower end of the cartridge to show the shape of the perforate tear opening at the lower end with the upwardly extending slot to permit viewing of the contents at the lower end of the cartridge;

FIG. 7 is a back view of the lower end of the cartridge;

DETAILED DESCRIPTION OF THE INVENTION

Figure 1:
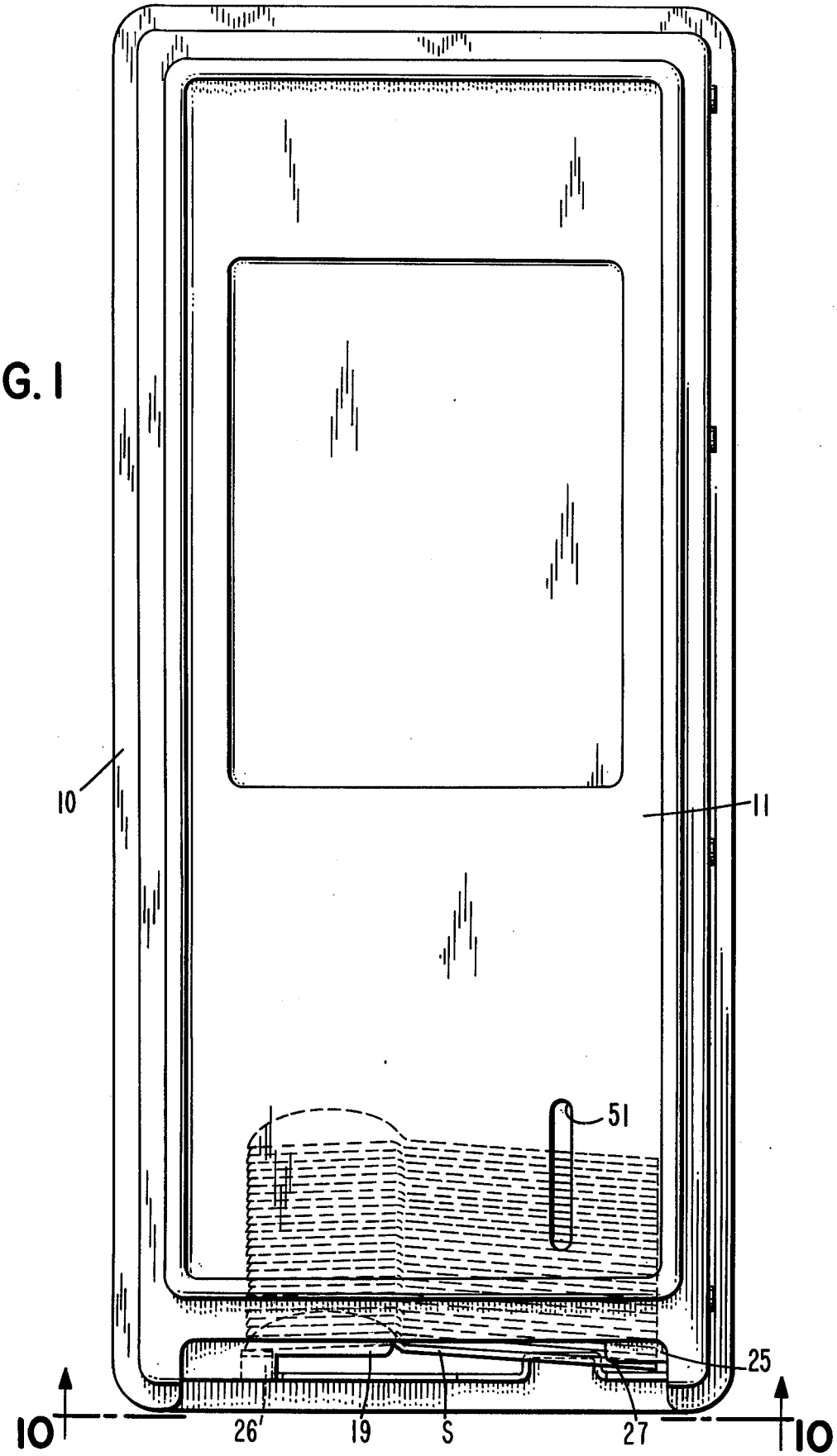
FIG. 1 is a front elevational view of the cartridge holder and dispenser mounted in a vertical position with a cartridge inserted and the door closed and with the dispenser and cartridge openings at the lower end.

Referring to FIGS. 1, 2 and 8–11 of the drawings, the cartridge holder is seen to be an elongate receptacle or box 10 preferably formed of molded sheet plastic material and having a front door 11 vertically hinged at 12 along one side of the holder box. The back wall 13 of the holder is provided with key slot openings 14–16 to enable the holder to be mounted in vertical position to any convenient supporting surface within a dispensing establishment. The lower end of the door 11 is provided with a grip button 17 to cooperate with a similar grip button 18 on a lower interior face wall 19 of the holder box to secure the door in closed position until it is desired to forceably open the door for access to the cartridge within the holder. The grip buttons are comprised of well known textile locking fibers but could be permanent magnet structures, or the like.

Figure 2:
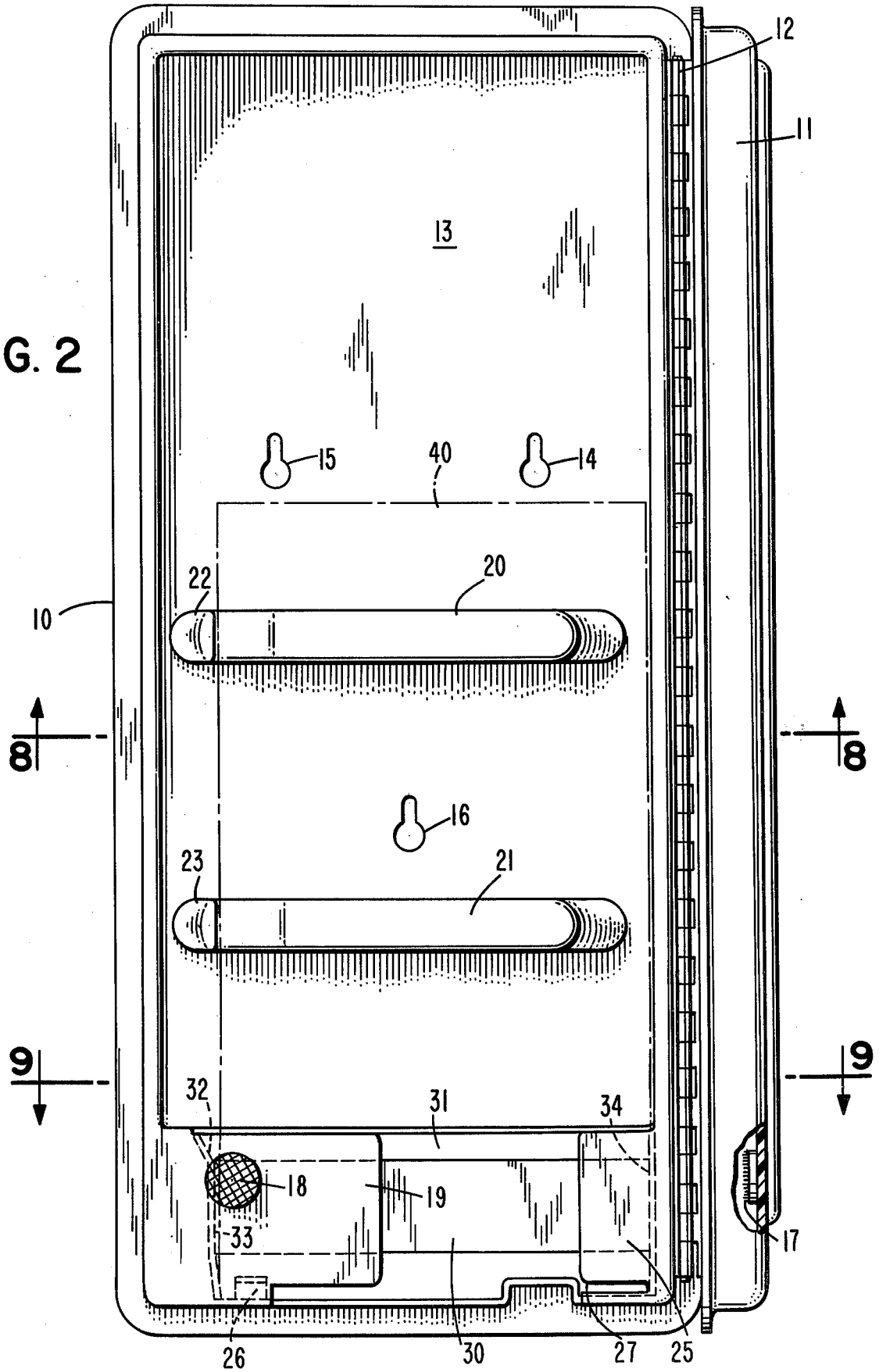
FIG. 2 is a view similar to FIG. 1 but with the door opened and the cartridge removed.
Figure 8:
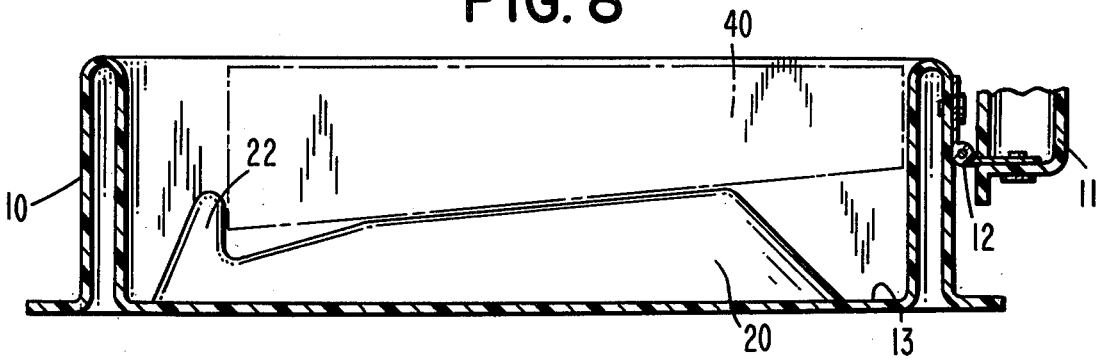
FIG. 8 is a sectional view of the holder on the line 8—8 of FIG. 1 as seen in the direction of the arrows, with the door opened.
Figure 11:
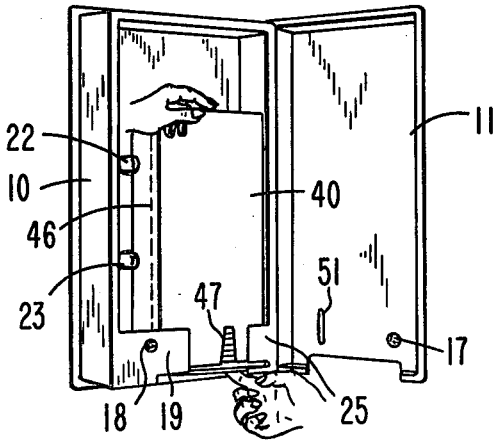
FIG. 11 is an elevational view to show the manner of placing the cartridge within the holder with the door open.

As seen most clearly by FIG. 2, the interior back wall 13 of the holder 10 is formed with projections 20,21 having end hooks 22,23, respectively, for properly positioning the cartridge within the holder when it is placed therein in the manner shown by FIG. 11 of the drawings. Also, as shown by FIG. 8, the projections, such as the projection 20, are tapered to accommodate the tapering cross-sectional dimensions of the cartridge to be later described in more detail.

Figure 9:
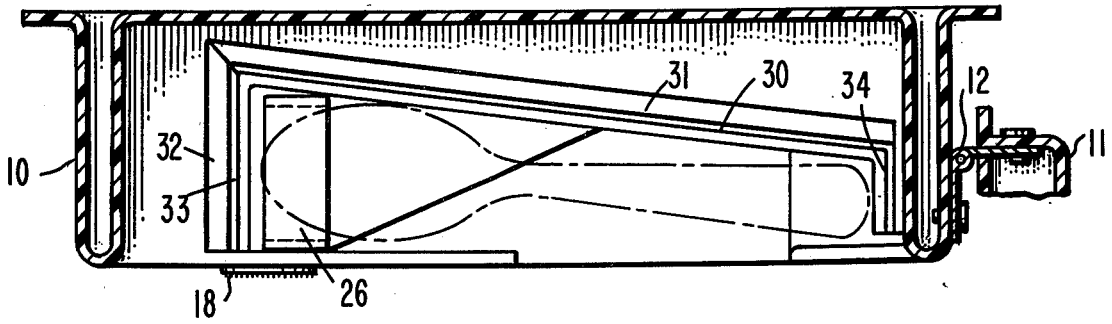
FIG. 9 is a sectional view on the line 9—9 of FIG. 1 as seen in the direction of the arrows, with the door opened and a cartridge in position.
Figure 10:
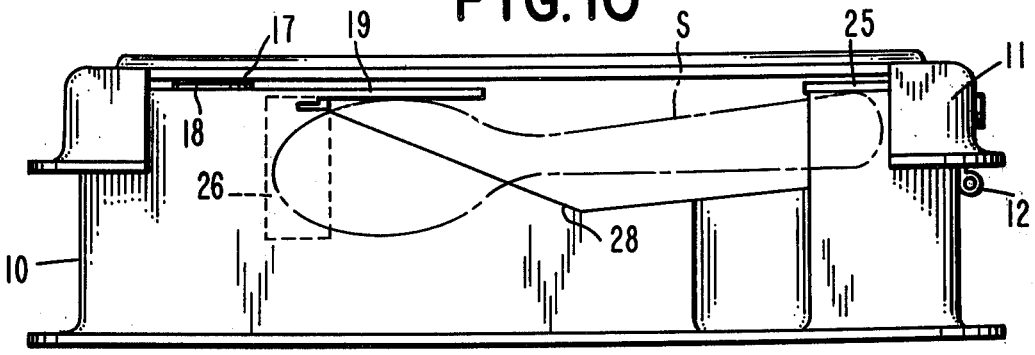
FIG. 10 is a bottom view of the holder with the door closed and showing in dotted lines the lowermost spoon to be dispensed.

With particular reference to FIGS. 2 and 9, the lower end of the holder 10 is provided with shaped wall surfaces 30–34 which act as a funnel to receive and guide the insertion of the open end of the cartridge 40 when it is being placed in the holder and firmly seated at the lower end of the holder in the manner to be described in connection with FIG. 11. The holder front wall projection 19, at its lower end, together with the holder front wall projection 25 serve to retain the lower end of the cartridge 40 in the position shown in FIG. 11 when the cartridge is placed within the holder for subsequent use in dispensing articles.

The lower end of the holder 10 is provided with an upwardly extending step projection 26 upon which one end of the lowermost article to be dispensed, which in the case of spoon articles is the spoon end, is engaged and supported. Thus, as most clearly shown in FIG. 1, the lowermost article S and the stack of articles within the cartridge are inclined so that a portion of the handle of the article S intermediate its length is engaged by the corner 27 of the front wall projection 25 to normally prevent unintentional removal or dispensing of the lowermost article S to be dispensed. The lower opening in the front of the holder, as formed by the shape of the projecting walls 19 and 26, together with the bottom wall opening 28, enable a user to grasp the lowermost article S and flex it downward to disengage the article handle and the projecting corner 27 of the front wall 26 so that only the lowermost article S may be removed.

Referring now to FIGS. 3–7 of the drawings, the article cartridge 40 may be in the form of a cardboard box containing a prepackaged stack of thin elongate flexible articles such as the plastic spoons 41, as shown. The lower end of the front wall of the cartridge box 40 is provided with a perforated tear opening bottom 42 to be opened and removed when the cartridge is to be inserted in the holder for dispensing purposes. The back wall of the cartridge 40 is perforated at 43, which together with side wall perforations (not shown), enables the entire bottom of the cartridge to be removed, as described above. As seen most clearly by FIGS. 4 and 5 of the drawings, the cross-sectional dimensions of the cartridge are tapered to provide a wide side end wall 44 and a narrow side end wall 45 to conform generally to the shape of the articles contained therein, such as spoons as shown. A fold line or crease 46 is provided along the wide end wall 44 to provide a degree of resilience for such end wall so that when the cartridge is placed within the holder in the manner shown by FIG. 11, and the holder door 11 is closed, the cartridge 40 will be squeezed between the projections 20,21 and the inside wall surface of the door 11 to firmly retain the cartridge in the dispensing position within the holder with the wide side of the cartridge in a predetermined position. Obviously the particular shape of the projections 20,21 and the cross-sectional dimensions of the cartridge 40 will be chosen to accommodate a particular shape of cartridge containing a given shape of articles, such as spoons, forks, knives and the like. Also, it should be understood that the resilient fold line 46 for the wide side end wall 44 of the cartridge 40 may be omitted without departing from the spirit of the invention.

Referring again to FIGS. 1, 6 and 11 of the drawings, it will be seen that the perforation line 42 at the bottom end of the front wall of the cartridge 40 extends upwardly at 47 to form a slotted opening and a slot opening 51 is provided in the front door 11 to register with the cartridge opening formed by the opening tear perforations 47 when the door 11 is closed. Thus, the remaining supply of articles at the lower end of the cartridge may be viewed while the cartridge is in the holder with the door closed.

Various modifications will occur to those skilled in the art.

We claim:

1. An article dispenser for elongate thin flexible articles comprising, a cartridge of stacked thin flexible articles, said cartridge having a bottom opening for access to the lowermost stacked article, a cartridge holder having a pivoted front door to be opened for positioning a cartridge within the holder, holding projections on the inside of the back wall of the holder to position a cartridge within the holder and with the article opening of the cartridge at the lower end of the holder and hold the cartridge in position when said door is closed, a step projection on one side at the bottom of the holder to incline the stack of articles at the bottom of the cartridge and holder when the holder is vertically positioned with the cartridge opening at the lower end, and a bottom access opening in the holder shaped to normally retain the lowermost inclined article within the cartridge and holder and to permit manual access to enable a user to grip and bend the lowermost article whereby only the lowermost article may be bent to conform to the shape of the access opening and thereby be removed from the cartridge and cartridge holder.

2. The invention of claim 1 wherein the thin flexible article to be dispensed is a plastic spoon, said cartridge is a cardboard box shaped with a wider cross-sectional dimension at one side than at the other side to accommodate the spoon portion of the spoon at the wide side and the handle portion of the spoon at the narrow side, and said holding projections within the cartridge holder being shaped to accommodate and receive the cartridge holder with the wider side portion along a predetermined side of the holder.

3. The invention of claim 2 wherein the wider side portion of the cartridge is provided with a fold line along its length to provide a resilient flexibility of that side portion of the cartridge to assist in retaining the cartridge in position within the holder when the door is closed and the inner side of the closed door is engaging the cartridge to squeeze the cartridge in the held position.

4. The invention of claim 1 wherein the opening of said cartridge is slotted upwardly on the front wall of the cartridge and the door of said holder is provided with a slot opening in registry with the cartridge slot when the cartridge is in the holder whereby the supply of articles remaining in the bottom of the cartridge may be viewed with the cartridge holder door closed.

* * * * *